United States Patent [19]

Seats

[11] Patent Number: 5,065,713

[45] Date of Patent: Nov. 19, 1991

[54] MOUNTING BRACKETS FOR MOUNTING ENGINE ASSECCORIES

[76] Inventor: William R. Seats, 656 E. Cypress, Covina, Calif. 91723

[21] Appl. No.: 502,984

[22] Filed: Apr. 2, 1990

[51] Int. Cl.[5] ..... F02F 7/00

[52] U.S. Cl. ..... 123/195 A; 123/198 R

[58] Field of Search ..... 123/195 A, 198 E, 198 R, 123/198 C; 248/205.1

[56] References Cited

U.S. PATENT DOCUMENTS

| | | | |
|---|---|---|---|
| 3,018,667 | 1/1962 | Spietz | 123/195 A |
| 3,362,243 | 1/1968 | Ferguson | 123/195 A |
| 3,730,147 | 5/1973 | Buchwald | 123/195 A |
| 4,342,290 | 8/1982 | Drakulic | 123/198 CX |
| 4,633,828 | 1/1987 | Steele | 123/195 A |

*Primary Examiner*—E. Rollins Cross
*Assistant Examiner*—Thomas N. Moulis
*Attorney, Agent, or Firm*—Boniard I. Brown

[57] ABSTRACT

Mounting brackets for mounting engine accessories, such as custom air conditioning compressors, alternators, and the like, on certain types of automobile engines and other engines, particularly engines such as small block Chevrolet engines having factory formed front end surfaces, top surfaces, and tapped holes which can be utilized to mount the brackets on the engines without the necessity of drilling and tapping holes in the engine.

26 Claims, 2 Drawing Sheets

MOUNTING BRACKETS FOR MOUNTING ENGINE ASSECCORIES

BACKGROUND OF THE INVENTION

1. Field of the Invention

This invention relates generally to automotive equipment and more particularly to novel mounting brackets for mounting engine accessories, especially custom accessories such as custom air conditioner compressors, custom alternators and the like, on automobile engines and other internal combustion engines.

2. Prior Art

Many automobile enthusiasts, particularly those commonly known as hot rodders, have a keen, often compulsive, interest in customizing their vehicles. Automobile customization covers a wide assortment of customizing procedures ranging from essentially cosmetic changes, such as custom paint jobs and custom interior alterations, to complex vehicle body or engine alterations. This invention is concerned primarly with automobile engine customization and will be described in this context, although the invention may be utilized on other internal combustion engines for other types of vehicles.

The engine customizing procedure with which this invention is concerned involves mounting custom engine accessories, particularly custom air conditioning compressors (A/C compressors) and custom alternators, on certain types of internal combustion engines, especially certain types of automobile engines. The prior art is replete with a vast assortment of mounting arrangements for this and other related purposes. Among the prior patents in this field are the following: U.S. Pat. Nos. 2,856,785; 2,857,996; 2,939,627; 3,274,841; 4,452,418; and 4,779,834. None of the available engine accessory mounting arrangements are totally satisfactory for the purposes contemplated in this invention. Accordingly, there is a definite need for improved engine accessory mounting brackets for these purposes.

SUMMARY OF THE INVENTION

This invention provides such improved engine accessory mounting brackets and particularly mounting brackets for mounting engine accessories, particularly custom A/C compressors and custom alternators, on certain types of internal combustion engines, especially certain types of automobile engines. The the type of engine with which the invention is concerned is one having a front, forwardly facing surface or surfaces on the front end of the engine body and a top surface on the top of the engine body adjacent its front end. The engine preferably also has factory tapped holes in these surfaces. One such engine is the automobile engine known as a small block Chevrolet engine. The invention will be described in connection with this particular engine. It will become readily evident as the description proceeds, however, that mounting brackets constructed in accordance with the invention may be mounted on other engines.

Very simply stated, the invention provides an engine accessory mounting bracket having a base portion with a normally rear side, means for mounting this base portion on an engine of the type described with the rear side of the base portion seating against the front end surface of the engine, and normally upstanding accessory mounting means on the base portion for mounting an engine accessory in a position normally above the base portion and the adjacent portion of the engine and with a selected axis of the accessory, such as the rotation axis of the rotor of an A/C compressor or alternator, transverse to the rear side of the base portion and substantially parallel to the rotation axis of the engine crankshaft. The preferred accessory mounting means comprise normally upstanding accessory mounting arms joined to and located forwardly of the rear side of the base portion and having normally upper ends for attachment to the mounted accessory at positions spaced about and along the accessory in such a way as to firmly mount it on the base portion.

The preferred mounting bracket embodiments discribed in this disclosure are intended for mounting an A/C compressor and an alternator, respectively, on a standard small block Chevrolet engine of the kind mentioned earlier. The base portions of these preferred brackets have holes which are located to register with the existing factory tapped holes in the front end surfaces of the engine. One bracket is secured to its front end surface by a single bolt which extends through a hole in its base portion and is threaded in a factory tapped hole in the engine and by a rear anchor member on the base portion which is secured to the top engine surface by a bolt threaded in the factory tapped hole in the top surface. The other described bracket is secured to its engine front end surface by three bolts which extend through holes in its base portion and are threaded in the factory tapped holes in the latter surface.

The accessory mounting means of these preferred accessory mounting brackets comprise a pair of normally upstanding accessory mounting arms and a third normally upstanding accessory mounting arm all located forwardly of the rear side of the base portion. The two arms of the arm pair have normally upper ends aligned on and spaced along a common axis transverse to the rear side of the base portion for attachment to the bottom of the mounted accessory, i.e. compressor or the alternator, as the case may be, adjacent its front and rear ends, respectively. The third accessory mounting arm has an upper end disposed for attachment to the top of the mounted accessory adjacent one end and is arranged to reinforce the bracket against deflection axially of the accessory by vibration and vehicle motion generated forces. This third support arm is a discrete arm member which is adjustable, by loosening a single bolt, for the purpose of adjusting the mounted accessory relative to the engine. This adjustment, for example, permits adjustment of the tension in the accessory drive belt through which the accessory rotor is driven from the engine. The preferred brackets have a strong modular construction which facilitates and reduces the cost of fabrication of the brackets and permits surface finishing of the brackets by painting, plating, or otherwise without the risk of shadowing, such as nickel shadowing during chrome plating.

Brackets according to the invention are simple to assemble and mount on an engine. When thus mounted, the brackets present an attractive balanced appearance which is particularly suited to and greatly enhances the appearance of hot rod engines. The brackets permit easy access to other engine components without removal of the brackets. The brackets also firmly support the mounted accessories against vibrational and vehicle motion generated forces. It should be noted at the outset that while the present mounting brackets are described in the context of their use on one particular engine, namely a small block Chevrolet engine, brackets according to the invention may be installed on other engines which have or can be provided with factory formed front end surfaces and tapped bracket bolt holes in these surfaces.

DESCRIPTION OF THE PREFERRED EMBODIMENTS

Figure 1:
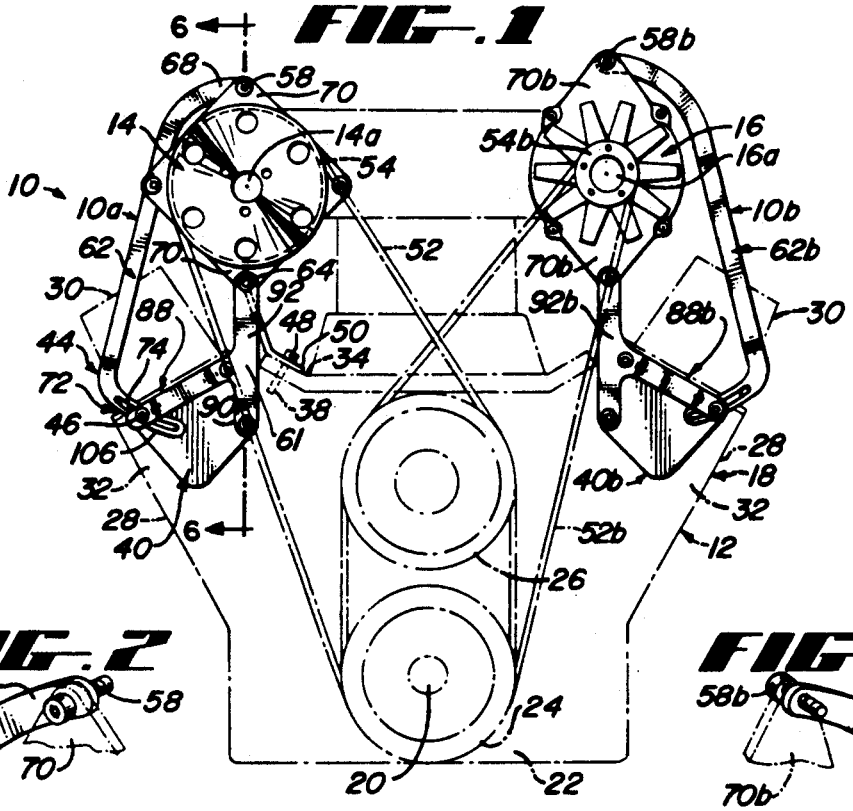
FIG. 1 is a front elevation of a small block Chevrolet engine, shown in phantom lines, and a pair of accessory mounting brackets according to the invention mounted on the engine and supporting an A/C compressor and an alternator, respectively.
Figure 2:
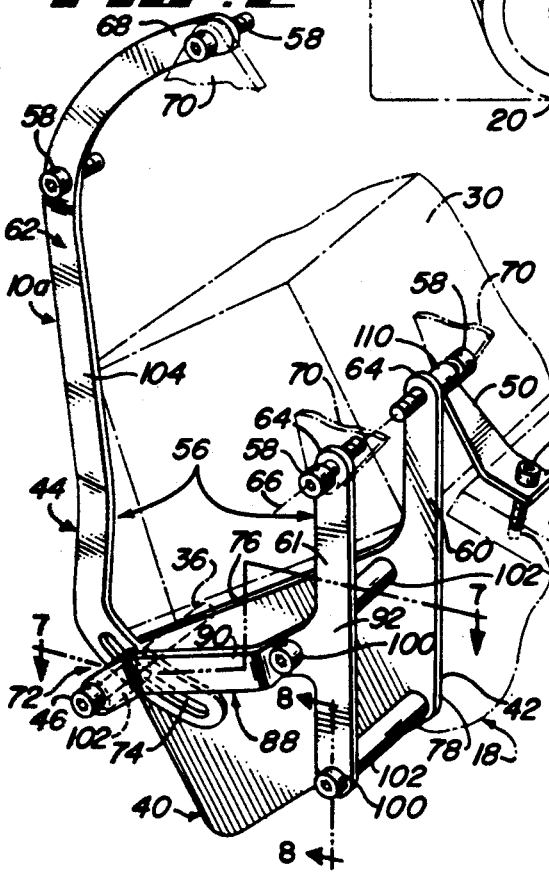
FIG. 2 is an enlarged perspective view of the left hand bracket in FIG. 1 and the adjacent portion of the engine.
Figure 3:
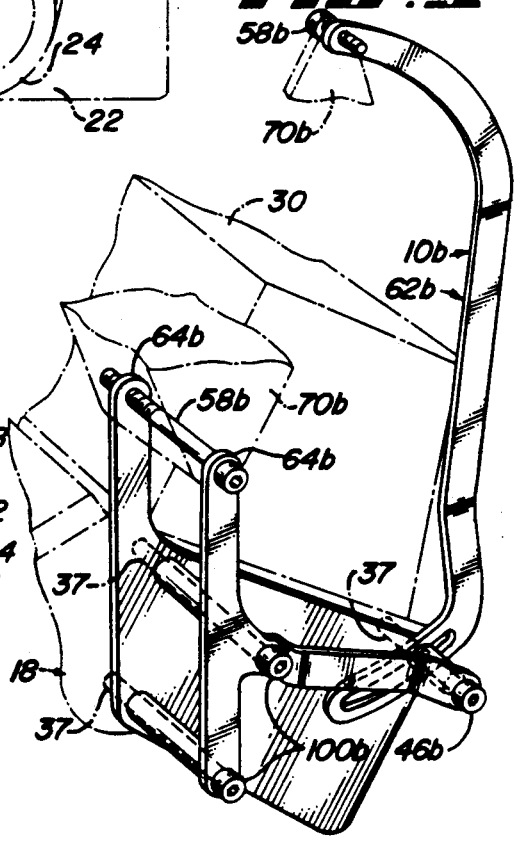
FIG. 3 is an enlarged perspective view, similar to FIG. 2, of the right hand bracket and engine portion in FIG. 1.

Referring now to these drawings, reference numeral 10 designates, collectively, two accessory mounting brackets 10*a* and 10*b* according to the invention. Reference numeral 12 designates an automobile engine, shown in phantom outline, of the kind on which the brackets are designed to be mounted for the purpose of mounting automotive accessories 14 and 16 on the engine. The particular accessories 14 and 16 shown are an A/C compressor and an alternator, respectively, having rotors 14*a* and 16*a*.

The engine 12 is entirely conventional and hence need be described only in sufficient detail to enable a full and complete understanding of the invention. With this in mind, the engine 12 shown is a small block Chevrolet engine which is commonly used in hot-rods and on which the illustrated accessory mounting brackets 10*a*, 10*b* of the invention are especially designed to be mounted. As mentioned earlier and will become evident from the ensuing description, however, mounting brackets constructed in accordance with the invention are not limited to use on the particular engine 12 shown. Engine 12 has a body 18 in which an engine crankshaft (not shown) is rotatable on an axis 20. The front end of this crankshaft extends forwardly beyond the front end 22 of the engine body 18 and mounts a driving pulley 24. A second idler pulley 26 is mounted on the front end of the engine directly over the driving pulley 24. The engine 12 is a "V" engine so that its body 18 has at opposite sides thereof upper, laterally outwardly inclined body portions 28 which contain the engine cylinders and valves (not shown). Mounted on the upper sides of these body portions are removable valve covers 30.

At the front ends of the upper engine body portions 28 are front, forwardly facing factory formed surfaces 32. These surfaces are relatively flat and disposed substantially in a common plane normal to the crankshaft axis 20. At the top of the engine body 12 is a relatively flat top surface 34 which substantially parallels the axis 20 and extends to the adjacent front end surface 32. Entering the left hand front end surfaces 32 substantially normal to the surface is a single factory tapped hole 36. Three factory tapped holes 37 enter the right hand engine surface 32. Entering the top surface 34 is a factory tapped hole 38 substantially normal to this surface. As will be explained presently, this invention utilizes the engine surfaces 32, 34 and tapped holes 36, 37 for mounting the accessory brackets 10 on the engine. These surfaces and tapped holes all exist on a standard small block Chevrolet engine. Accordingly, there is no need to drill and tap the holes 36, 38 before installing the brackets 10. As mentioned earlier and will be understood from the ensuing description, however, accessory mounting brackets according to the invention may be installed on other types of engines which have or can be provided with appropriate front end and top surfaces and tapped holes in these surfaces.

Except for certain differences to be explained, the two mounting brackets 10*a*, 10*b* are mirror images of one another. Accordingly, a description of one and an explanation of the bracket differences will suffice for both brackets. Bracket 10*a* will be described.

Bracket 10*a* includes a base portion 40 having a normally rear side 42, and means 44 on the base portion, forwardly of its rear side, for mounting an accessory, in this case the A/C compressor 14, on the base portion in a position normally above the base portion with the rotation axis of the accessory rotor 14*a* extending transversely of and substantially normal to the rear side 42. The bracket 10*a* is secured to the left hand front end engine surface 32 with its rear side second against the surface by two bolts 46 and 48. Bolt 46 extends through the base portion 40 and is threaded in the factory tapped hole 36 in the front end surface for clamping the base portion against the surface. Bolt 48 extends through an anchor member 50 secured to the rear side of the base portion 40 and is threaded in the upper factory tapped hole 38 in the engine for clamping the anchor member to the top engine surface 34. The bracket 10*a*, when thus mounted on the engine 12, supports the compressor 14 in a position above the adjacent portion of the engine with the rotation axis of the compressor rotor 14*a* extending substantially parallel to the engine crankshaft axis 20. The compressor rotor 14*a* is driven from the engine by a belt 52 trained about a pulley 54 on the rotor and the engine pulleys 24, 26.

Referring now in more detail to the bracket 10*a*, its accessory mounting means 44 comprises normally upstanding accessory support arms 56 joined to and located forwardly of the rear side of the bracket base portion 42 and bolts 58 for securing the arms to the compressor 14. The support arms 56 include a pair of arms 60, 61 and a third arm 62. The upper ends 64 of the arms 60, 61 are aligned on and spaced along a common axis 66 extending transversely of and generally normal to the rear side 42 of the base portion. The upper end 68 of the third arm 62 is disposed above the upper ends 64 of the arms 60, 61. The upper end 68 of the third arm 62 and the upper end 64 of one of the arms 60,61, in this case the front most arm 61, are substantially aligned in a common plane normal to the axis 66.

The upper ends 64 of the arms 60, 61 and the upper end 68 of the third arm 62 are disposed to straddle the compressor 14 diametrically with the arm pair ends 64 located below and spaced axially of the compressor and the third arm end 68 located above the compressor. The compressor has radial lugs 70 which the upper arm ends overlap in side by side relation and in which the arm bolts 58 are threaded to firmly secure the bracket arms to the compressor. The frontmost arm 61 and the third arm 62 are secured to the same end, namely the front end, of the compressor.

One important feature of the invention resides in the fact that the accessory support arms 60, 61, 62 of the mounting bracket 10*a* are relatively adjustable to adjust the compressor 14 for purpose of properly tensioning the compressor drive belt 52 or otherwise positioning the compressor relative to the engine 12. To this end, the third bracket arm 62 is a discrete arm member. The lower end of this arm member is mounted on the bracket base portion 40 by means 72 for adjustment, and preferably both pivotal and endwise adjustment, of the arm member relative to the arms 60, 61 in a plane substantially parallel to the rear side 42 of the base portion. To this end, the third arm mounting means 72 comprises a longitudinal slot 74 in the lower end of the third arm member 62 through which the bracket mounting bolt 46 extends to form a slide pivot for the arm member.

Figures 4, 5, 6, 7, 8:
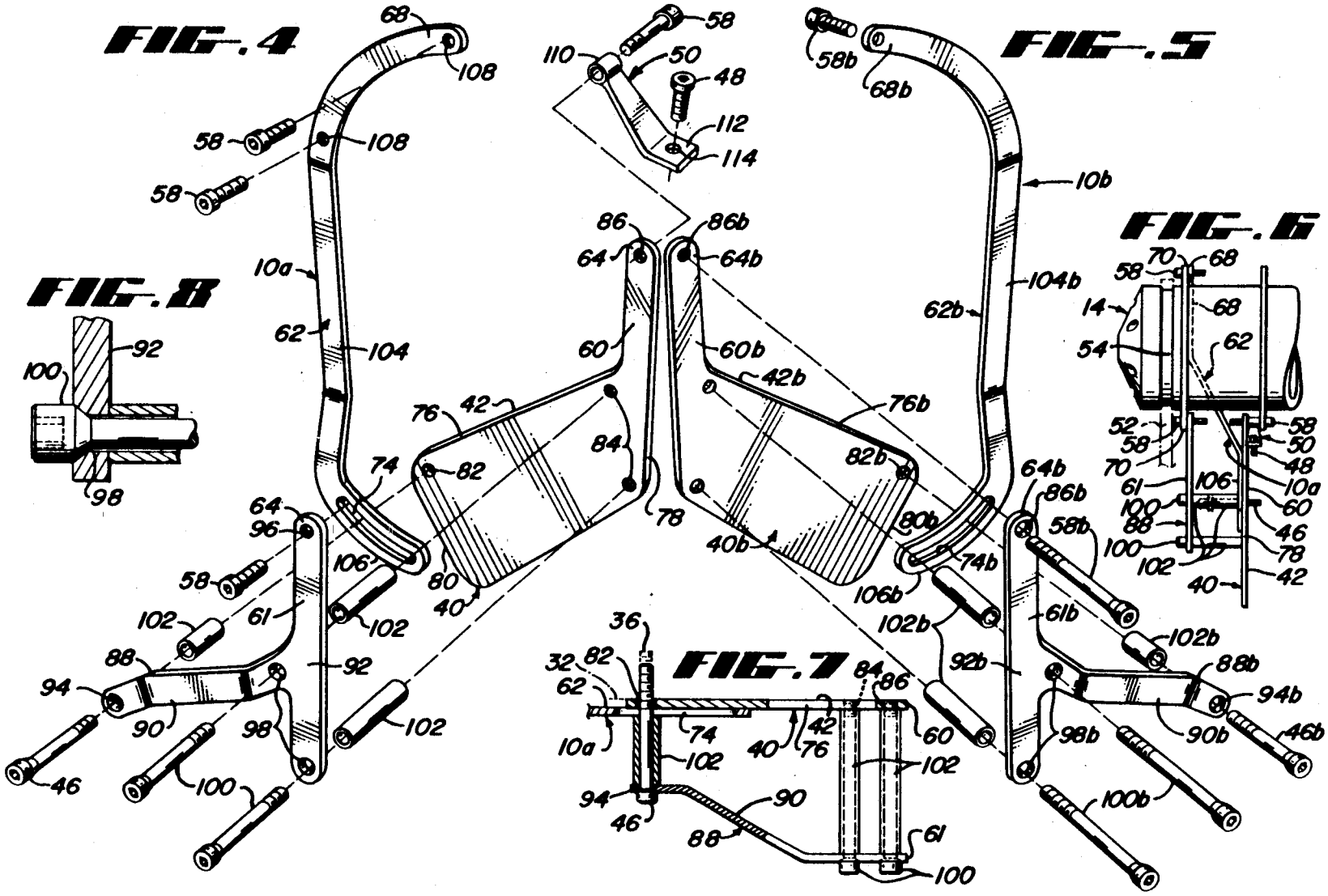
FIG. 4 is an enlarged exploded perspective view of the left hand bracket in FIG. 1.
FIG. 5 is an enlarged exploded perspective view of the right hand bracket in FIG. 1.
FIG. 6 is a section taken on line 6—6 in FIG. 1.
FIG. 7 is a section taken on line 7—7 in FIG. 2.
FIG. 8 is an enlarged section taken on line 8—8 in FIG. 2.

As mentioned earlier, the preferred accessory mounting bracket of the invention has a unique modular construction which facilitates low cost manufacture of the bracket and painting, chrome plating, or otherwise surface finishing the bracket without the risk of shadowing. The bracket 10*a* illustrated has this modular construction which will now be described. Referring particularly to FIGS. 4, 6, and 7, the bracket base portion 40 comprises a flat base plate which has a normally upper edge 76 and opposite ends 78 and 80. Integrally joined to and extending edgewise and upwardly from the upper edge 76 of the base plate 40 is an arm-like extension which forms the accessory support arm 60. This arm and the adjacent edge of the base plate 40 are inclined at an oblique angle to the length of the base plate for reasons to be explained. Extending through the base plate 40 is a single hole 82 at the end 80 of the plate and a pair of holes 84 at the opposite end 78 of the plate. At the upper end of the plate arm 60 is a hole 86.

The base plate 40 is positioned against the left hand front end surface 32 of the engine 12 with the rear side 42 of the plate seating against the surface and the upper edge 76 of the plate extending substantially along the front edge of the top surface of the adjacent upper engine portion 28. The base plate hole 82 is located on the base plate so that when the plate is thus positioned on the engine, the hole registers with, i.e. is aligned with, the adjacent factory tapped hole 36 in the front end surface. The bracket mounting bolt 46 extends through the base plate hole 82 and is threaded in the engine hole 36 to firmly clamps the base plate 40 against the engine front end surface 32. The angle between the base plate arm 60 and the upper base plate edge 76 is made such that the arm extends generally vertically above the adjacent portion of the engine, as shown, when the base plate is thus mounted on the engine.

In addition to the base plate 40, the modular mounting bracket 10*a* includes a discrete, generally T-shaped bracket member 88 at the front side of the base plate 40. This bracket member has a leg portion 90 and a transverse portion 92 integrally joined to one end of the leg portion. The upper end portion of the transverse portion 92 in FIG. 4 forms the accessory support arm 61 of the bracket. The bracket member 88 contains a hole 94 at the free end of the bracket member leg 90, a hole 96 at the upper end of the bracket member arm 61, and two additional holes 98 at the lower end of the bracket member transverse portion 92 and at the juncture of this bracket portion and the leg portion, respectively.

The bracket member 88 is secured to and spaced from the front side of the base plate 40 by fasteners and spacers. The fasteners include the bracket mounting bolt 46 and additional bolts 100. The bracket mounting bolt 46 extends through the hole 94 in the free end of the bracket member leg 90 and through the base plate hole 82 and beyond the rear base plate side 42, as shown in FIG. 7. Bolts 100 extend through the bracket member holes 98 and are threaded in the base plate holes 84 with the rear ends of the bolts flush with the rear base plate side 42, as also shown in FIG. 7. The spacers comprise sleeves 102 which surround the bolts 46, 100 and space the base plate 40 and bracket member 88 from one another. The leg 90 of the bracket member 88 is bent, as shown in FIG. 7, to shorten the required length of the bracket mounting bolt 46 which must extend a distance beyone the rear base plate side for engagement in the tapped hole 36 in the engine. The transverse portion 92 of the bracket member is disposed at the same oblique angle to the leg 90 as the oblique angle between the base plate arm 60 and upper base plate edge 76.

When the bracket member 88 is installed on the base plate 40, the upper edge of the bracket member leg 90 and the upper edge 76 of the base plate are preferably located substantially in a common plane normal to the rear side 42 of the base plate, as shown best in FIG. 1. The bracket member arm 61 parallels and is aligned with the base plate arm 60 normal to the base plate, and the holes 86, 96 in these arms are substantially coaxially aligned on the common axis 66. These holes receive bolts 58 for securing the upper arm ends 64 to bottom lugs 70 at the ends of the compressor 14. The length of the spacers 102 on the bolts 100 is such as to space the upper ends 64 of the arms 60, 61 the proper distance to enable the arm ends to engage these lower mounting lugs on the compressor.

The third accessory support arm 62 is a generally U-shaped arm member having a central portion 104 and curved upper and lower end portions 68, 106 which extend to the same side of the central portion. The upper end portion 68 has two holes 108 receiving bolts 58 for securing the upper arm end to upper lugs 70 of the compressor 14. The lower end portion 106 of the arm member contains the slot 74 through which extends the bracket mounting bolt 46, whereby the arm member is adjustable pivotally about the bolt and endwise in a plane substantially parallel to the rear side 42 of the mounting plate 40. This lower end portion of the arm member 62 is positioned between the mounting plate 40 and the rear end of the spacer sleeve 102 about the mounting bolt 46. Accordingly, tightening this bolt to clamp the mounting plate to the front end engine surface 32 clamps the lower end of the arm member between the mounting plate and the sleeve to secure the arm member in its adjusted position. Loosening the mounting bolt frees the arm member for adjustment. Referring to FIG. 6, the arm member 62 is bent so that its upper and lower end portions 68, 106 are flat and disposed in spaced parallel planes. The upper end portion is located forwardly of the lower end portion and substantially in a common plane, parallel to the rear side 42 of the base plate 40, with the upper end 64 of the lower accessory support arm 61. This bent configuration of the third arm 62 serves to reinforce the bracket against fore and aft deflection in a direction normal to the rear side 42 of the base plate 40.

The bracket anchor member 50 comprises a strap with a bearing 110 at one end and a bent flat end portion 112 at the other end containing a hole 114 to receive the anchor bolt 48. The bolt 58 for securing the base plate accessory support arm 60 to the compressor extends through the anchor bearing 110 and the hole 86 in the latter arm to effectively pivotally mount the anchor member on the base plate 40 at the rear side thereof.

It is now evident that the accessory mounting bracket 10*a* is mounted on the left hand front end surface 32 of the engine 12 in FIG. 1 by placing the rear side 42 of the mounting plate 40 against the surface, aligning the bracket mounting bolt 46 with the factory tapped hole 36 in the surface, and then threading the bolt into the hole to clamp the mounting plate against the surface. The end portion 112 of the rear bracket anchor member 50 is placed against the top engine surface 34 and is clamped to this surface by the anchor bolt 48. The rear compressor mounting bolt 58 is inserted through the anchor bearing 110 and into the hole 86 in the adjacent rear accessory support arm 60. The compressor 14 is then secured by the bolts 58 to the upper ends of the accessory support arms 60, 61, and 62 and adjusted to obtain the desired tension in the compressor drive belt 52. After this adjustment, the bracket mounting bolt 46 and all of the compressor mounting bolts 58 are tightened to firmly secure the bracket to the engine and the compressor to the bracket. Further adjustment of the compressor can be accomplished by simply loosening the bracket mounting bolt 46.

According to a preferred feature of the invention, the under sides of the heads of all the bolts 46, 100, 100*b* used in the bracket are beveled and the front ends of their respective bracket holes are tapered or countersunk in the manner shown in FIG. 8 to provide a firm wedge lock between the various parts without marring or peeling of painted or plated surfaces of the bracket.

As noted earlier, the right hand accessory or alternator mounting bracket 10*b* in FIG. 1 is, with certain exceptions now to be described, a mirror image of the left hand bracket 10*a*. For this reason, the above description of bracket 10*a* applies equally well to the bracket 10*b* when read in conjunction with the following discussion so that bracket 10*b* will not be described in the same detail as bracket 10*a*. The reference numerals applied to the bracket 10*b* in the drawings are the same, with the suffix b, as those applied to the corresponding parts of the bracket 10*a*.

The base portion or base plate 40*b* of the bracket 10*b* is identical to the base plate 40 of the bracket 10*a*. The base plate 40*b*, however, is turned back to front relative to the base plate 40 so that the front side of the base plate 40 is the rear side 42*b* of the base plate 40*b*. The accessory support arm 62*b* and bracket member 88*b* of the mounting bracket 10*b* are exact mirror images of the accessory support arm 62 and bracket member 88, respectively, of the mounting bracket 10*a*. The anchor member 50 of the bracket 10*a* is omitted in the bracket 10*b*. Rather than being threaded in the base plate 40*b* with their rear ends flush with the rear side of the plate, as are the bolts 100 which join the base plate 40 and bracket member 88 in the bracket 10*a*, the corresponding bolts 100*b* of the bracket 10*b* extend through the holes 84*b* in the base plate 40*b* and a distance beyond the rear side 42*b* of the plate. The accessory mounting bolts 58 at the upper ends 64 of the bracket arms 60, 61 of bracket 10*a* are replaced, in the bracket 10*b*, by one long bolt 58*b*'. The bracket 10*b* is otherwise identical to the bracket 10*a*.

The bracket 10*b* is mounted on the right hand front end surface 32 of the engine 12. As mentioned earlier, this right hand surface contains three factory tapped holes 37 arranged in a triangular pattern. The three holes 82*b*, 84*b* in the bracket base plate 40*b* are located to register with the factory tapped engine holes 37 when the base plate is placed against the right front end surface in the position shown in FIG. 1, wherein the upper edge 76*b* of the base plate extends substantially along the upper edge of the right hand upper engine body portion 28. The bracket 10*b* is secured to the engine by threading the bolts 46*b*, 100*b* into the three engine holes 37. When the bracket is thus mounted on the engine, its accessory support arms 60*b*, 61*b* extend generally vertically above the adjacent portion of the engine, and its adjustable third support arm 62*b* extends above the arms 60*b*, 61*b*.

The alternator 16 is mounted between the upper ends 64*b* of the support arms 60*b*, 61*b* and the upper end 68*b* of the of the adjustable support arm 62*b*. The alternator rotor is driven from the engine 12 by a drive belt 52*b* trained about the engine pulleys 24, 26 and a pulley 54*b* on the rotor. The upper ends 64*b* of the support arms 60*b*, 61*b* straddle a longitudinal bottom lug 70*b* on the alternator and are secured to this lug by the long bolt 58*b*'. This bolt extends through the lug 70*b* and is threaded in the arm 60*b*. The upper end of the arm 62*b* is secured by its bolt 58*b* to a top lug 70*b* on the alternator. The alternator is adjustable to properly tension the alternator drive belt 52*b* by loosening the adjustable arm pivot bolt 46*b* and adjusting the arm 62*b*, in essentially the same way as described earlier in connection with bracket 10*a*.

It now evident that the mounting brackets 10*a* and 10*b* have all of the features and advantages mentioned earlier. Accordingly, it unneccessary to repeat or elaborate on these features and advantages at this point. It is worthwhile to note, however, that the base plates 40, 40*b* of the two brackets are interchangeable. The arms members 62, 62*b* and bracket members 88, 88*b*, being mirror images of one another, can be conveniently fabricated by initially forming identical parts of the proper shape and then bending these identical parts to the proper final shape of the arm and bracket members. It will be further evident that mounting brackets according to the invention can be made for mounting on engines, other than the short block Chevrolet engine described, having suitable front end mounting surfaces but other factory tapped hole arrangements than that shown, by appropriately locating the mounting bolt holes in the brackets. Moreover, brackets of the invention may be mounted on engines without appropriate factory tapped holes by simply drilling and tapping suitable holes in the engine. It may even be possible to provide suitable front end bracket mounting surfaces on engines not having such surfaces.

I claim:

1. A mounting bracket for mounting an accessory on an internal combustion engine having a forwardly facing front end surface, comprising:

a base portion having a normally rear side to be secured to the engine with said rear side seating against the front end surface of the engine, means on said base portion forwardly of said rear side and normally projecting above said base portion for mounting the accessory on said base portion with the accessory in a position normally above the base portion, and wherein said accessory mounting means comprises a pair of normally upstanding accessory support arms joined to and located forwardly of said rear side of said base portion and having normally upper ends which are normally located above said base portion and are aligned on and spaced along a common axis transverse to said rear side of the base portion, a third normally upstanding accessory support arm joined to said base portion and having a normally upper end normally located above the upper ends of said arm pair, and means for securing said upper arm ends to the accessory with the accessory positioned between the upper ends of said arm pair and the upper end of said third arm, said base portion comprises a flat base plate having a normally upper edge and a normally front side, one arm of said arm pair is integrally joined to and extends edgewise and normally upwardly from the upper edge of said base plate, said bracket includes a discrete bracket member at the front side of said base plate having a normally upstanding portion forming the other arm of said arm pair, and means securing said bracket member to said base plate, said third arm comprises a discrete arm member having a normally lower end, and said mounting bracket includes means mounting the lower end of said third arm member on said base portion for adjustment of the third arm relative to said arm pair in a plane substantially parallel to the rear side of said base portion.

2. A mounting bracket according to claim 1 wherein:

said base plate has opposite ends, said one arm of said arm pair is located at one end of said base plate, said bracket member comprises a generally T-shaped member including a leg portion extending generally endwise of and having one end disposed opposite the other end of said base plate, and a normally generally upright transverse portion at the other end of said leg portion having an upper end forming said other arm of said arm pair, said means securing said bracket member to said base plate comprise fasteners extending between the bracket plate and bracket member and including means for spacing the bracket plate and bracket member, and said means mounting the lower end of said third arm member on said base plate comprises one of said fasteners extending between said base plate and said one end of said bracket member leg portion and through a longitudinal slot in said lower end of said third arm member.

3. A mounting bracket for mounting an accessory on an internal combustion engine having a forwardly facing front end surface, comprising:

a base portion having a normally rear side to be secured to the engine with said rear side seating against the front end surface of the engine, means on said base portion forwardly of said rear side and normally projecting above said base portion for mounting the accessory on said base portion with the accessory in a position normally above the base portion, and wherein said accessory mounting means comprises a pair of normally upstanding accessory support arms joined to and located forwardly of said rear side of said base portion and having normally upper ends which are normally located above said base portion and are aligned on and spaced along a common axis transverse to said rear side of the base portion, a third normally upstanding accessory support arm joined to said base portion and having a normally upper end normally located above the upper ends of said arm pair, and means for securing said upper arm ends to the accessory with the accessory positioned between the upper ends of said arm pair and the upper end of said third arm, the upper end of one arm of said arm pait and the upper end of said third arm are located substantially in a common plane parallel to the rear side of said base portion, said means for securing said upper arm ends to the accessory comprise fasteners extending through the upper arm ends parallel to said common axis, the fasteners in the upper ends of said arm pair are substantially coaxially aligned on said common axis, and said third arm has a lower end spaced along said axis from the upper end of the third arm.

4. A mounting bracket according to claim 2 wherein:

the upper end of one arm of said arm pair and the upper end of said third arm member are located substantially in a common plane parallel to the rear side of said base portion, said means for securing said upper arm ends to the accessory comprise fasteners extending through the upper arm ends parallel to said common axis, the fasteners in the upper ends of said arm pair are substantially coaxially aligned on said common axis, and the upper and lower ends of said third arm member are spaced along said common axis.

5. In combination:

an internal combustion engine having a front forwardly facing surface, an engine accessory, an accessory mounting bracket including a base portion having a normally rear side secured to said engine with said rear side seating against said front end surface of the engine, and means on said bracket base portion forwardly of said rear side of said base portion mounting said accessory on said base portion with the accessory located above said engine, and wherein said accessory mounting means comprises a pair of upstanding accessory support arms joined to and located forwardly of said rear side of said base portion and having upper ends aligned on and spaced along a common axis extending lengthwise of said engine, a third upstanding accessory support arm joined to said base portion and having an upper end located above the upper ends of said arm pair, and means securing said upper arm ends to said accessory with the accessory positioned between the upper ends of said arm pair and the upper end of said third arm, said base portion comprises a flat base plate having an upper edge and a front side, one arm of said arm pair is integrally joined to and extends edgewise and upward from the upper edge of said base plate, said bracket includes a discrete bracket member at the front side of said base plate having an upstanding portion forming the other arm of said arm pair, and means joining said bracket member and said base plate, said third arm comprises a discrete arm member having a normally lower end, and said mounting bracket includes means mounting the lower end of said third arm member on said base portion for adjustment of the third arm relative to said arm pair in a plane substantially normally to said common axis.

6. The combination of claim 5 wherein:

said base plate has opposite ends, said one arm of said arm pair is located at one end of said base plate, said bracket member comprises a generally T-shaped member including a leg portion extending generally endwise of and having one end disposed opposite the other end of said base plate, and a generally upright transverse portion at the other end of said leg portion having an upper end forming said other arm of said arm pair, said means joining said bracket member and said base plate comprise fasteners extending between the bracket plate and bracket member, and means spacing the bracket plate and bracket member, and said means mounting the lower end of said third arm member on said base plate comprises one of said fasteners extending between said base plate and said one end of said bracket member leg portion and through a longitudinal slot in said lower end of said third arm member.

7. The combination of claim 6 wherein:

the lower end of said third arm member is located adjacent said base plate, the upper end of the normally forward arm of said arm pair and the upper end of said third arm are located substantially in a common plane normal to said common axis, said means securing said upper arm ends to said accessory comprise fasteners extending through the upper arm ends parallel to said common axis, and the fasteners in the upper ends of said arm pair are substantially coaxially aligned on said common axis.

8. In combination:

an internal combustion engine having a front forwardly facing surface, an engine accessory, an accessory mounting bracket including a base portion having a normally rear side secured to said engine with said rear side seating against said front end surface of the engine, and means on said bracket base portion forwardly of said rear side of said base portion mounting said accessory on said base portion the accessory located above said engine, and wherein said accessory mounting means comprises a pair of upstanding accessory support arms joined to and located forwardly of said rear side of said base portion and having upper ends aligned on and spaced along a common axis extending lengthwise of said engine, a third upstanding accessory support arm joined to said base portion and having an upper end located above the upper ends of said arm pair, and means securing said upper arm ends to said accessory with the accessory positioned between the upper ends of said arm pair and the upper end of said third arm, said accessory has front and rear ends and radial lugs at its ends, the upper ends of said arm pair are secured the front and rear end lugs, respectively, of said accessory at the underside of the accessory, and the upper end of said third arm member is secured to one lug of said accessory at the upper side of the accessory.

9. The combination of claim 8 wherein:

said third arm comprises a discrete arm member having a lower end, said mounting bracket includes means mounting the lower end of said third arm member on said base portion for adjustment of the third arm relative to said arm pair in a plane substantially normal to said common axis, and the ends of said third arm member are spaced along said common axis.

10. A mounting bracket for mounting an accessory on an internal combustion engine having a forwardly facing front end surface, a first threaded bore entering said front end surface, a top surface laterally inward on the engine from said first bore, and a second threaded bore entering said top surface just to the rear of said front end surface, said mounting bracket comprising:

a base portion having a rear side, first and second opposite ends, and a hole extending through said first end, and said base portion being positionable on the engine with (a) said rear side of said base portion seating against the front end surface of the engine, (b) said hole in said base portion aligned with the first threaded engine bore, and (c) said second end of said base portion located adjacent the second threaded engine bore, anchor means secured to the rear side of said base portion adjacent said second end of the base portion and containing a hole, and said bracket being positionable on the engine with (a) said rear side of said base portion seating against the front end surface of the engine, (b) said hole in said base portion aligned with the first threaded engine bore, (c) said second end of said base portion disposed inwardly, laterally of the engine, relative to said first base portion end and adjacent the second threaded engine bore, and (d) said anchor means seating against said top surface of the engine with said hole in the anchor means aligned with the second threaded engine bore, whereby said bracket can be secured to the engine by a first bolt extending through said hole in said base portion and threaded in the first engine bore and a second bolt extending through said hole in said anchor means and threaded in the second threaded engine bore, and means on said base portion forwardly of said rear side of the base portion for mounting the accessory on said base portion with the accessory in a position normally above the base portion.

11. A mounting bracket A mounting bracket for mounting an accessory on an internal combustion engine having a forwardly facing front end surface and three threaded bores entering said front end surface in a triangular pattern, comprising:

a base portion having a normally rear side to be secured to the engine with said rear side seating against the front end surface of the engine, means on said base portion forwardly of said rear side and normally projecting above said base portion for mounting the accessory on said base portion with the accessory in a position normally above the base portion, and said base portion three holes in a triangular pattern matching that of said threaded engine bore pattern to be aligned with said engine bores for receiving bolts to threaded in said bores for securing said base portion against said front end surface.

12. A mounting bracket for mounting an accessory on an internal combustion engine, comprising:

a base member having a first side for seating against the engine and an opposite side, a bracket member at said opposite side of said base member, fasteners extending between said members for releasably rigidly joining said members in spaced relation including at least one fastener which extends through said members and a substantial distance beyond said first side of said base member for engagement with said engine to secure said mounting bracket to the engine, and accessory support means including accessory support arms on said base member and said bracket member, respectively, and means for securing said arms to said accessory.

13. A mounting bracket for mounting an engine accessory on an internal combustion engine, comprising:

a base member to be secured to said engine, a bracket member at one side of said base member, a pair of accessory support arms on said base member and bracket member, respectively, including attachment means for securing said arms to said accessory, a third accessory support arm having a fixed end positioned between said base member and said bracket member and an opposite free end spaced from said arm pair, and attachment means for securing said free arm end to said accessory, and wherein fasteners extending between said members for releasably rigidly joining said members in spaced relation including one fastener which extends between said bracket member and said base member through an opening in said fixed end of said third arm for rigidly clamping said fixed third arm end between said members.

14. A mounting bracket according to claim 13 wherein:

said opening is enlarged relative to said one fastener to permit adjustment of said third arm relative to said members laterally of said of said one fastener.

15. A mounting bracket according to claim 13 wherein:

said base member comprises a generally flat base plate having an edge, one arm of said arm pair is integral with said base plate and extends edgewise of said base plate from said base plate edge, and the other arm of said arm pair is integral with said bracket member.

16. A mounting bracket according to claim 13 wherein:

the arms of said arm pair have free ends aligned on and spaced along a common axis transverse to said base plate, and said attachment means are located at said free arm ends.

17. A mounting bracket according to claim 16 wherein:

said free and fixed third arm ends are disposed in planes transverse to and spaced along said axis, whereby said third arm reinforces said bracket in the direction of said axis.

18. A mounting bracket according to claim 13 wherein:

said base member comprises a generally flat base plate having an edge, one arm of said arm pair is integral with said base plate and extends edgewise of said base plate from said base plate edge, said bracket member has a generally T-shape including a leg section extending generally lengthwise of said base plate edge and a lateral section at one end of leg section extending generally lengthwise of said base plate arm and having opposite end portions extending beyond opposite sides of said leg section, one end portion of said lateral section forms the other arm of said arm pair, the arms of said arm pair have free ends aligned on and spaced along a common axis transverse to said base plate, said attachment means are located at said free arm ends, said fixed end of said third arm is disposed between said base plate and the other end of said leg section, said one fastener extends through said other end of said leg section, and said fasteners include other fasteners which extend through said bracket member adjacent the outer extremity of the other end portion of said lateral section and adjacent the juncture of said leg and lateral sections.

19. In combination:

an internal combustion engine, an engine accessory, and a mounting bracket mounting said accessory on said engine comprising a base member having a first side seating against the engine and an opposite side, a bracket member at said opposite side of said base member, fasteners extending between and releasably rigidly joining said members in spaced relation including at least one fastener which extends through said members and into said engine and secures said mounting bracket to the engine, accessory support arms on said base member and said bracket member, respectively, and means securing said support arms to said accessory.

20. In combination:

an internal combustion engine, an engine accessory, and a mounting bracket mounting said accessory on said engine comprising a base member secured to said engine, a bracket member at one side of said base member, a pair of accessory support arms on said base member and said bracket member, respectively, a third accessory support arm having a fixed end positioned between said base member and said bracket member and an opposite free end spaced from said arm pair, attachment means securing said arm pair and said free arm end to said accessory, and fasteners extending between and rigidly joining said members in spaced relation including one fastener which extends between said bracket member and said base member through an opening in said fixed end of said third arm to rigidly clamp said fixed arm end between said members.

21. A combination according to claim 20 wherein:

said opening is enlarged relative to said one fastener to permit adjustment of said third arm relative to said members laterally of said of said one fastener.

22. A combination according to claim 20 wherein:

said base member comprises a generally flat base plate having an edge, one arm of said arm pair is integral with said base plate and extends edgewise of said base plate from said base plate edge, and the other arm of said arm pair is integral with said bracket member.

23. A combination according to claim 20 wherein:

the arms of said arm pair have free ends aligned on and spaced along a common axis transverse to said base member, and said attachment means are located at said free arm ends.

24. A combination according to claim 23 wherein:

said free and fixed ends of said third arm are disposed in planes transverse to and spaced along said axis, whereby said third arm reinforces said bracket in the direction of said axis.

25. A combination according to claim 20 wherein:

said base member comprises a generally flat base plate having an edge, one arm of said arm pair is integral with said base plate and extends edgewise of said base plate from said base plate edge, said bracket member has a generally T-shape including a leg section extending generally lengthwise of said base plate edge and a laterally section at one end of leg section extending generally lengthwise of said base plate arm and having opposite end portions extending beyond opposite sides of said leg section, one end portion of said lateral section forms the other arm of said arm pair, the arms of said arm pair have free ends aligned on and spaced along a common axis transverse to said base plate, said attachment means are located at said free arm ends, said fixed end of said third arm is disposed between said base plate and the other end of said leg section, said one fastener extends through said other end of said leg section, and said fasteners include other fasteners which extend through said bracket member adjacent the outer extremity of the other end portion of said lateral section and adjacent the juncture of said leg and lateral sections.

26. A mounting bracket for mounting an accessory on an internal combustion, comprising:

a base member including a flat base plate to be secured to the engine, accessory mounting means on said base member for mounting the accessory on said base member, and wherein said accessory mounting means comprises a pair of accessory support arms having free ends aligned on and spaced along a common axis transverse to said base plate, a discrete third accessory support arm member having a free end spaced from the free ends of said arm pair and an opposite end, means mounting said opposite end of said third arm member on said base plate for adjustment of the third arm relative to said arm pair in a plane transverse to said axis, and means for securing said free arm ends to the accessory with the accessory positioned between the free ends of said arm pair and the free end of said third arm, one arm of said arm pair is integrally joined to and extends from one edge of said base plate edgewise of the base plate, and said bracket includes a discrete bracket member at one side of said base plate having a portion forming the other arm of said arm pair, and means securing said bracket member to said base plate.

* * * * *